US010539307B2

(12) United States Patent
Jurik et al.

(10) Patent No.: US 10,539,307 B2
(45) Date of Patent: Jan. 21, 2020

(54) LAMP CHANGE SYSTEM FOR AN AUTOMATED LUMINAIRE

(71) Applicant: Robe Lighting s.r.o., Roznov pod Radhostem (CZ)

(72) Inventors: Pavel Jurik, Prostredni Becva (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 16/115,077

(22) Filed: Aug. 28, 2018

(65) Prior Publication Data

US 2019/0056096 A1 Feb. 21, 2019

Related U.S. Application Data

(60) Provisional application No. 62/553,727, filed on Sep. 1, 2017.

(51) Int. Cl.
*F21V 21/30* (2006.01)
*F21V 19/00* (2006.01)
(Continued)

(52) U.S. Cl.
CPC ..... *F21V 21/30* (2013.01); *F21V 17/12* (2013.01); *F21V 19/004* (2013.01); *H05B 37/029* (2013.01)

(58) Field of Classification Search
CPC ..... F21V 21/30; F21V 19/02; F21V 19/04; F21V 17/12; F21V 19/004; H05B 37/029; F21W 2131/406
See application file for complete search history.

(56) References Cited

U.S. PATENT DOCUMENTS 5,361,191 A * 11/1994 Matsuzaki ..... F21S 41/196 362/549
2004/0095761 A1* 5/2004 Esakoff ..... F21V 19/04 362/648

FOREIGN PATENT DOCUMENTS

CN 101881392 A 11/2010
EP 0574013 A1 12/1993

OTHER PUBLICATIONS

European Extended Search Report; Application No. 18192012.5; dated Nov. 16, 2018; 9 pages.
(Continued)

*Primary Examiner* — Kevin Quarterman
(74) *Attorney, Agent, or Firm* — Conley Rose, P.C.; Grant Rodolph; Brooks W. Taylor

(57) ABSTRACT

A lamp mounting mechanism and automated luminaire are provided. A lamp head includes a lamp access panel and the lamp mounting mechanism. The lamp access panel can be removed to provide access to the lamp mounting mechanism. The lamp mounting mechanism includes a lamp mounting plate and a lamp retainer. A lamp is removably mounted in the lamp mounting mechanism, which aligns an optical axis of the lamp with a center of the lamp mounting plate. The lamp retainer includes a plurality of retaining clips that apply forces to flanges of the lamp to maintain the lamp in a fixed position relative to the lamp mounting plate. The retaining clips allow a user to rotate the lamp to position the flanges of the lamp in openings between the retaining clips. The openings between the retaining clips allow the user to remove the lamp from the lamp mounting plate.

19 Claims, 6 Drawing Sheets

(51) Int. Cl.
*H05B 37/02* (2006.01)
*F21V 17/12* (2006.01)

(56) References Cited

OTHER PUBLICATIONS

Chinese Office Action; Application No. 201811022589.X; dated Sep. 19, 2019; 22 pages.

* cited by examiner

LAMP CHANGE SYSTEM FOR AN AUTOMATED LUMINAIRE

CROSS-REFERENCE TO RELATED APPLICATIONS

This application also claims priority to U.S. Provisional Application No. 62/553,727 filed Sep. 1, 2017 by Pavel Jurik, et al. entitled, "Lamp Change System for an Automated Luminaire", which is incorporated by reference herein as if reproduced in its entirety.

TECHNICAL FIELD OF THE DISCLOSURE

The disclosure generally relates to automated lighting systems and more specifically to a lamp change system for an automated luminaire.

BACKGROUND

Luminaires with automated and remotely controllable functionality are well known in the entertainment and architectural lighting markets. Such products are commonly used in theatres, television studios, concerts, theme parks, night clubs, and other venues. A typical product will commonly provide control over the pan and tilt functions of the luminaire allowing the operator to control the direction the luminaire is pointing and thus the position of the light beam on the stage or in the studio. Typically, this position control is done via control of the luminaire's position in two orthogonal rotational axes usually referred to as pan and tilt. Many products provide control over other parameters such as the intensity, color, focus, beam size, beam shape, and beam pattern.

Recent improvements in automated lighting luminaires have led to increasing use of ultra short arc discharge lamps with an integrated reflector. Such lamps provide guaranteed and accurate factory pre-set positioning of the lamp within the reflector, which has long been an issue with such light sources. A downside of these lamps however is their larger size and very specific cooling needs. The larger diameter makes the mechanics of designing a lamp holder and retaining system much more difficult. In particular many prior art products require significant disassembly of the luminaire in order to access and change a broken or exhausted lamp. The relatively short life time of these lamps, typically only a few hundred hours, makes lamp replacement a common and time-consuming task. This need for disassembly often means that there are many loose parts to deal with, as well as multiple fasteners and other small components.

Prior art products with these complex lamp change systems make it difficult, if not impossible, to change lamps while the luminaire is installed in the lighting rig. Instead the user is typically required to remove the luminaire from the installation and change the lamp at a workbench. This is time consuming and, in some cases such as large theatrical or concert events where the luminaire is installed high up above a stage, impossible to achieve in a timely manner.

Compounding this is the need for extensive cooling which has in the past required surrounding the lamp with cooling fans and air ducts. These fans and air ducts make access for lamp change even more difficult.

Still another problem with prior art systems for lamp change is that the removable components result in the replacement lamp not being accurately positioned in the exact same position as the failed lamp. Reliance on fasteners and screws typically requires that the user manually realign the new lamp after installation.

There is a need for an improved lamp replacement and change mechanism that simplifies the lamp change process for lamps with integral reflectors in automated luminaires while maintaining accurate positioning of the lamp.

SUMMARY

In a first embodiment, a lamp mounting mechanism for use in an automated luminaire includes a lamp mounting plate and a lamp retainer. The lamp mounting plate includes a feature that engages flanges of a lamp that is removably mounted in the lamp mounting mechanism. The feature also aligns an optical axis of the lamp with a center of the lamp mounting plate. The lamp retainer is coupled to the lamp mounting plate and includes a plurality of retaining clips. The number of retaining clips equals the number of flanges of the lamp. The retaining clips apply forces to the flanges of the lamp to maintain the lamp in a fixed position relative to the lamp mounting plate when the flanges of the lamp are positioned between the retaining clips and the feature of the lamp mounting plate. The retaining clips also allow a user to rotate the lamp within the feature of the lamp mounting plate to position the flanges of the lamp in openings between the retaining clips. The openings between the retaining clips allow the user to remove the lamp from the feature of the lamp mounting plate.

In a second embodiment, an automated luminaire includes a lamp head, which includes a lamp access panel and a lamp mounting mechanism. The lamp access panel is removably mounted to the lamp head and forms a portion of a housing of the lamp head when mounted to the lamp head. The lamp mounting mechanism is adjustably mounted to the lamp head and is configured to be accessed by a user when the lamp access panel is removed. The lamp mounting mechanism includes a lamp mounting plate and a lamp retainer. The lamp mounting plate includes a feature that engages flanges of a lamp that is removably mounted in the lamp mounting mechanism. The feature also aligns an optical axis of the lamp with a center of the lamp mounting plate. The lamp retainer is coupled to the lamp mounting plate and includes a plurality of retaining clips. The number of retaining clips equals the number of flanges of the lamp. The retaining clips apply forces to the flanges of the lamp to maintain the lamp in a fixed position relative to the lamp mounting plate when the flanges of the lamp are positioned between the retaining clips and the feature of the lamp mounting plate. The retaining clips also allow the user to rotate the lamp within the feature of the lamp mounting plate to position the flanges of the lamp in openings between the retaining clips. The openings between the retaining clips allow the user to remove the lamp from the feature of the lamp mounting plate.

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION

Preferred embodiments are illustrated in the figures, like numerals being used to refer to like and corresponding parts of the various drawings.

Disclosed herein is an automated luminaire with a lamp head that includes a lamp access panel and a lamp mounting mechanism. The lamp access panel can be removed to provide access to the lamp mounting mechanism. The lamp mounting mechanism adjustably mounts a lamp in the lamp head. A lamp retainer applies forces to the lamp to keep it in a fixed position relative to a lamp mounting plate. A user can rotate the lamp to free it from the lamp retainer and remove the lamp from the lamp head.

Figure 1:
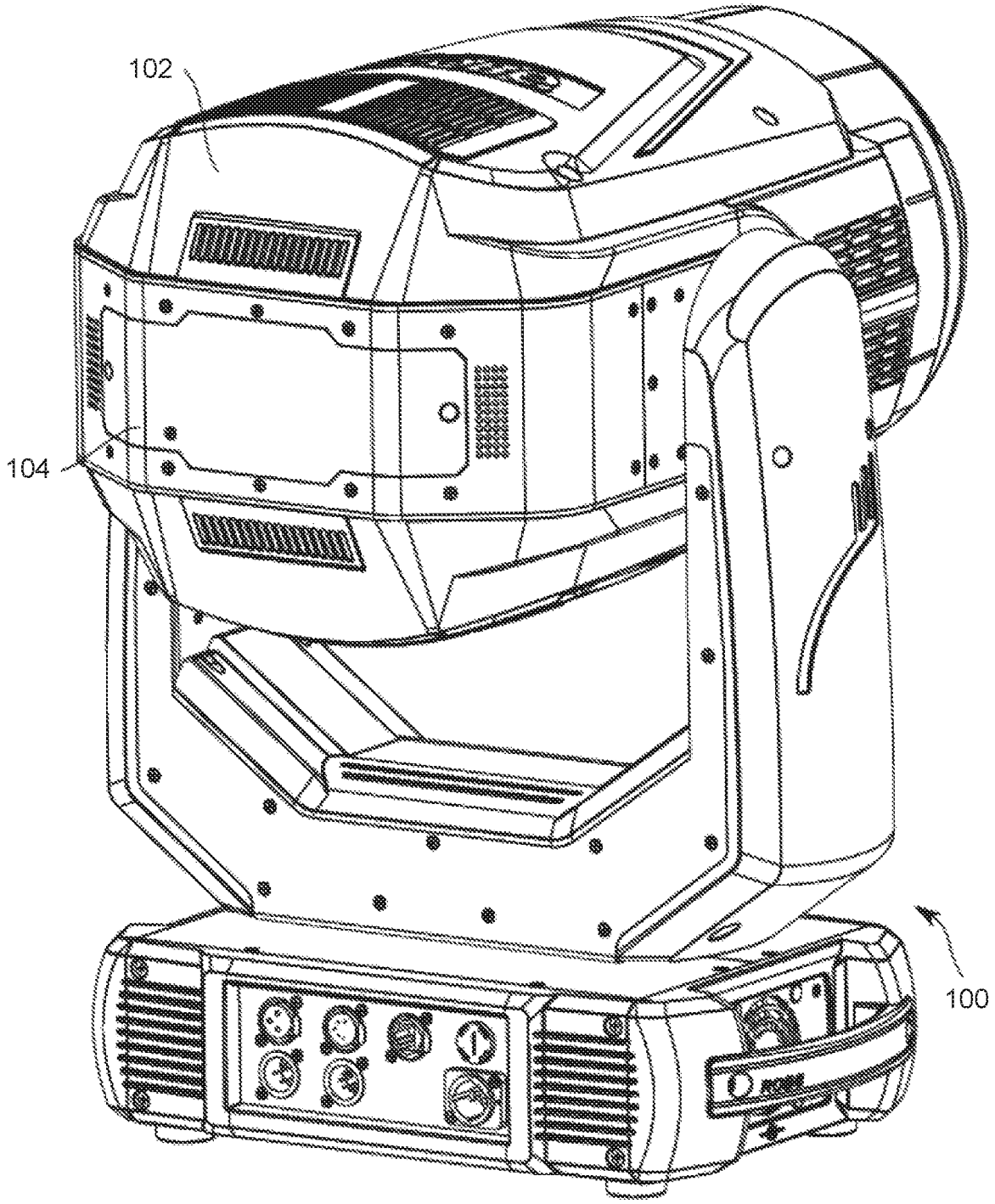
FIG. 1 illustrates an automated luminaire according to one embodiment of the disclosure.

FIG. 1 illustrates an automated luminaire 100 according to one embodiment of the disclosure. Automated luminaire 100 includes a lamp head 102 with a lamp access panel 104. Lamp access panel 104 forms a portion of a housing of the lamp head 102 and may be retained to lamp head 102 with captive screws or quick-release fasteners. Lamp access panel 104 is designed so as to have a good air seal between it and lamp head 102. A tight air seal ensures that the internal cooling air flow over the lamp is not disrupted by air leaks around lamp access panel 104.

Figure 2:
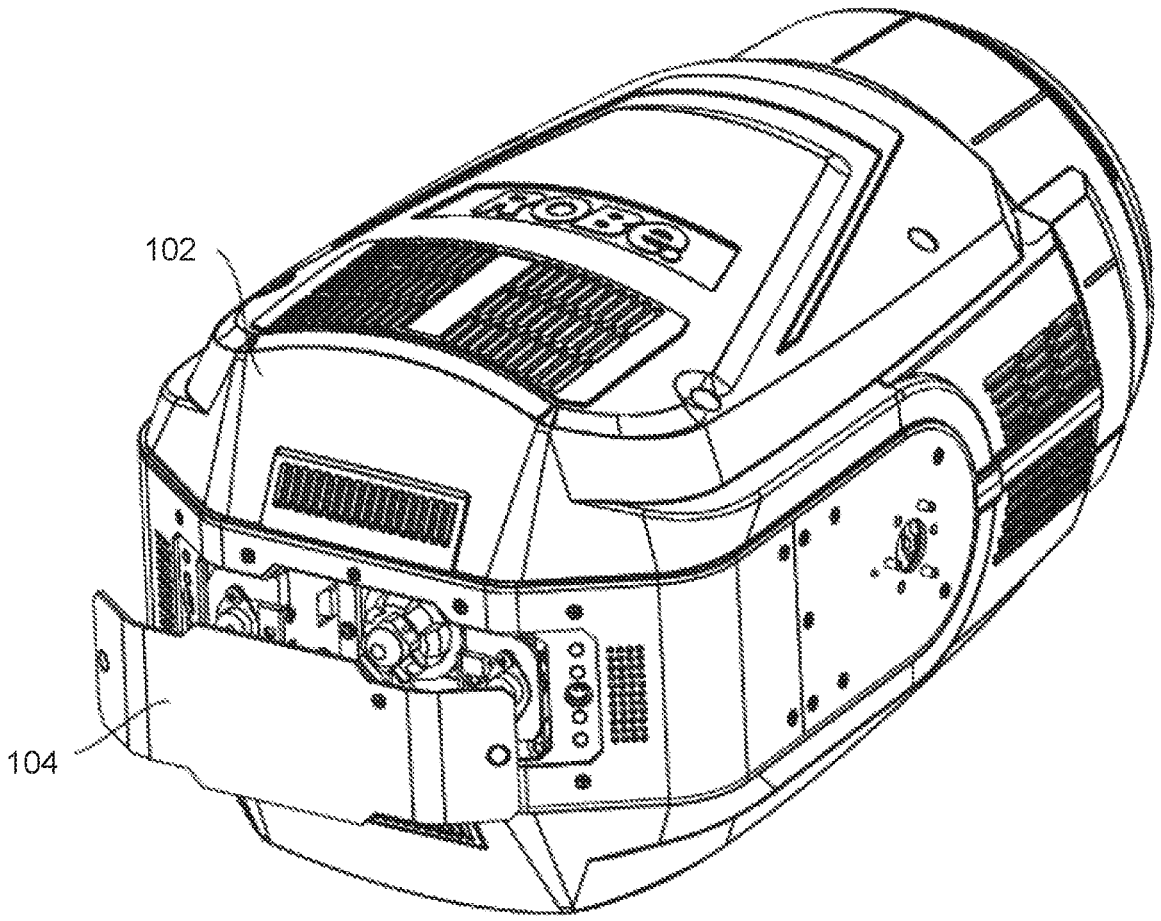
FIG. 2 illustrates a lamp head of the automated luminaire of FIG. 1 with a lamp access panel partially removed.

FIG. 2 illustrates a lamp head 102 of the automated luminaire 100 with a lamp access panel 104 partially removed. Lamp access panel 104 may remain connected to lamp head 102 via a safety bond, chain, or cable, such that it will not fall if dropped. This, along with the use of captive fasteners, permits lamp access panel 104 to be safely removed while the luminaire is still installed in position in a lighting rig above a performance area.

Figure 3:
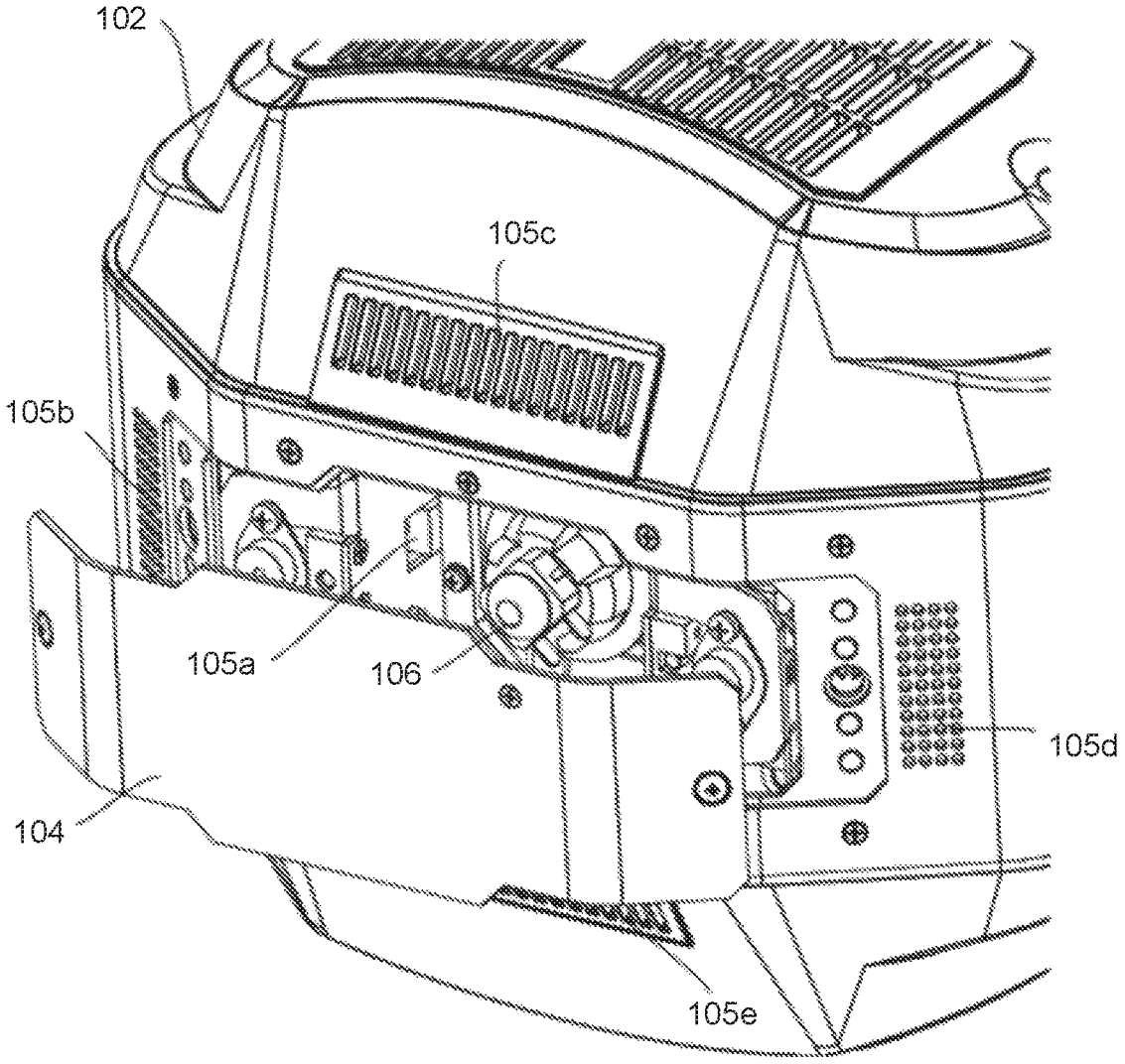
FIG. 3 provides a detail view of the lamp head of FIG. 2 with the lamp access panel partially removed.

FIG. 3 shows a detail view of the lamp head 102 with the lamp access panel 104 partially removed. A lamp 106 mounted within the lamp head 102 may be seen more clearly in FIG. 3. No other components of the luminaire obstruct access to the lamp 106 once lamp access panel 104 is removed. There is no need to remove fans, fasteners, cooling ducts, or other hardware prior to removing the lamp 106 from the lamp head 102.

The cooling system for lamp 106 comprises fans and ducts positioned on the sides, top, bottom, or front of the lamp. Careful design of air ducting and fan vents allows a desired air flow to be maintained across the lamp at all times when it is operating. Five exemplary air ducts, 105*a*, 105*b*, 105*e*, 105*d*, and 105*e* are shown in FIG. 3, all positioned out of the removal path of lamp 106.

Air is drawn into the lamp head 102 through the air ducts 105*b*, 105*c*, 105*d*, and 105*e* by one or more internal fans and expelled from the air duct 105*a* towards the lamp 106. The air ducts 105*b*, 105*c*, 105*d*, and 105*e* are all coupled to a common air chamber from which the fan draws air to expel through the air duct 105*a*. In other embodiments, additional fans may draw air from one or more of the air ducts 105*b*, 105*c*, 105*d*, and 105*e* to expel air through additional ducts located elsewhere around the lamp 106.

Figure 4:
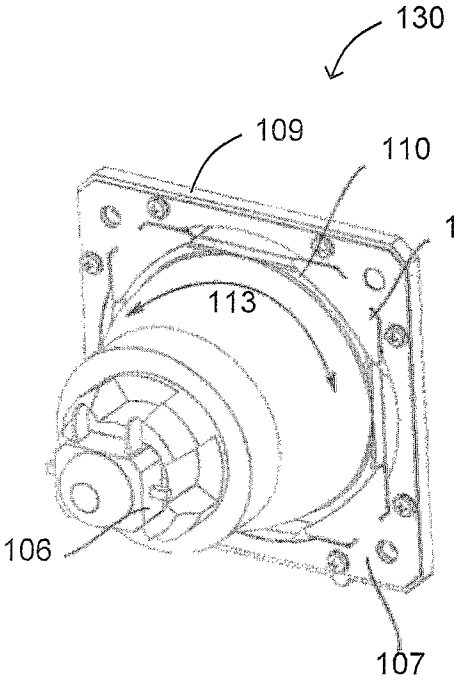
FIG. 4 illustrates a second step in the process of lamp removal according to the disclosure.
Figure 5:
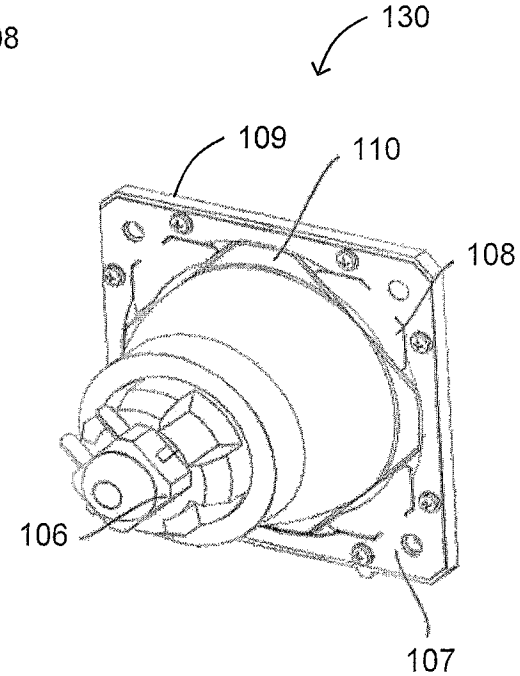
FIG. 5 illustrates a third step in the process of lamp removal according to the disclosure.
Figure 6:
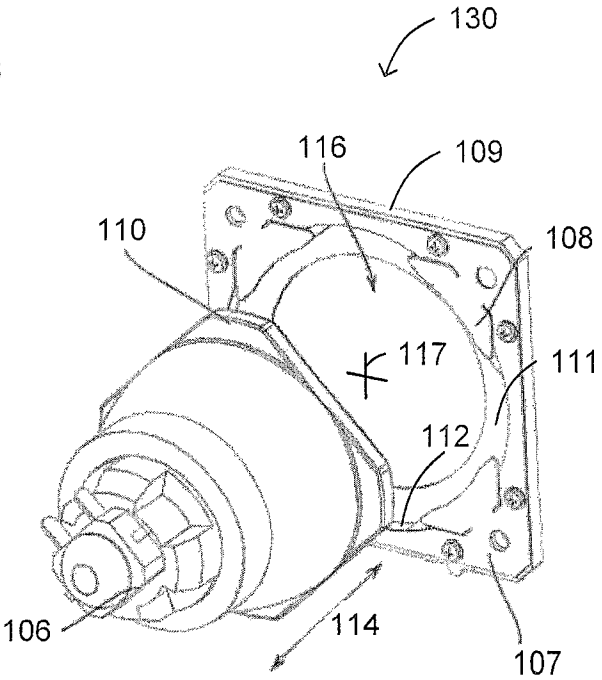
FIG. 6 illustrates a fourth step in the process of lamp removal according to the disclosure.

FIGS. 4-6 illustrate a lamp removal and replacement process according to the disclosure for the lamp 106 after the lamp access panel 104 has been removed from the luminaire head 102. The lamp 106 is removably mounted in a lamp mounting mechanism 130. The lamp mounting mechanism 130 comprises a lamp mounting plate 109. A lamp retainer 107 is fixedly attached to the lamp mounting plate 109.

The lamp mounting mechanism 130 is adjustably mounted to the chassis of the lamp head 102. The lamp mounting mechanism 130 is shown in isolation in FIGS. 4, 5, and 6, however, as may be seen in FIGS. 7 and 8, the lamp mounting mechanism 130 remains mounted in the lamp head 102 during the lamp removal and replacement process shown in FIGS. 4-7.

Removal of the lamp access panel 104 from the luminaire head 102 comprises a first step in the process of lamp removal according to the disclosure. FIG. 4 illustrates a second step in the process. In FIG. 4, it may be seen that the lamp 106 is retained by four lamp retaining clips 108, which are features of the lamp retainer 107. The lamp retainer 107 is formed of spring steel.

Four corner flanges 110 of the lamp 106 are securely and accurately retained behind the lamp retaining clips 108, which are deformed by the insertion of the lamp 106 and apply force to the corner flanges 110 by attempting to return to their original shape, holding the lamp 106 firmly against the lamp mounting plate 109. A feature of the lamp mounting plate 109 comprising an inset ring 111 and a shoulder 112 formed by the inset ring 111 provides both mechanical support and positioning for lamp 106. The lamp retaining clips 108 extend from the remainder of the lamp retainer 107 over the inset ring 111. A front face of the lamp 106 is held firmly against the inset ring 111 by the restorative force of the lamp retaining clips 108, preventing rotation of the lamp 106 relative to the lamp mounting plate 109 through friction. A diameter (dimension) of the shoulder 112 is sized to fit the corner flanges 110 and prevent radial movement of the lamp 106 away from a center of the lamp mounting mechanism 130.

To remove the lamp 106, a user grasps the lamp 106 and rotates it axially by hand, as shown by arrow 113. The lamp 106 may be rotated in either direction, as shown by arrow 113, until the lamp corner flanges 110 are positioned in openings between the lamp retaining clips 108, in a third step of the lamp removal process as shown in FIG. 5.

Once the lamp corner flanges 110 are clear of the lamp retaining clips 108, the lamp 106 may be pulled back, as shown by arrow 114, and removed from an aperture 116 in the lamp mounting plate 109, in a fourth step of the lamp removal process as shown in FIG. 6. The inset ring 111 and the shoulder 112, described above, may be seen more clearly in FIG. 6.

Installation of a new lamp follows the reverse process. A new lamp 106 is pushed up against the inset ring 111 of the lamp mounting plate 109, with the lamp corner flanges 110 positioned between the lamp retaining clips 108. The new lamp 106 is then axially rotated such that the lamp corner flanges 110 are secured under the lamp retaining clips 108. At this point, the new lamp 106 is both mechanically secured to the lamp mounting mechanism and an optical axis of the lamp head 102 is aligned by the lamp mounting plate 109 with a center 117 of the lamp mounting plate 109. The inset ring 111, the shoulder 112, and the aperture 116 of the lamp mounting plate 109 serve to aid the user in guiding lamp 106 into the correct position. In other embodiments, the lamp retaining clips 108 may be one or more separate elements that are attached to the lamp mounting plate 109.

Figure 7:
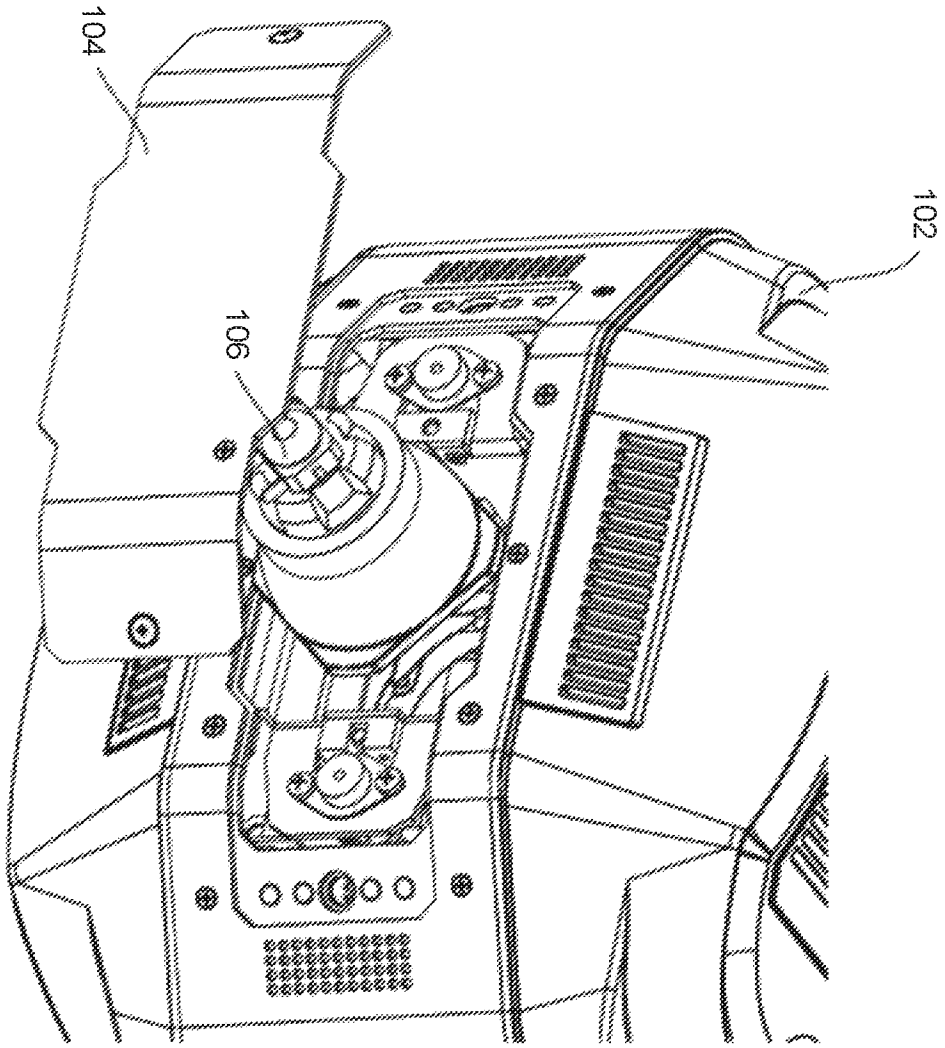
FIG. 7 illustrates the fourth step in the process of lamp removal according to the disclosure within an automated luminaire.

FIG. 7 illustrates a broader view of the lamp removal process according to the disclosure, showing the fourth step of the process, with the lamp 106 pulled back for replacement after having been released from the lamp retaining clips 108.

Figure 8:
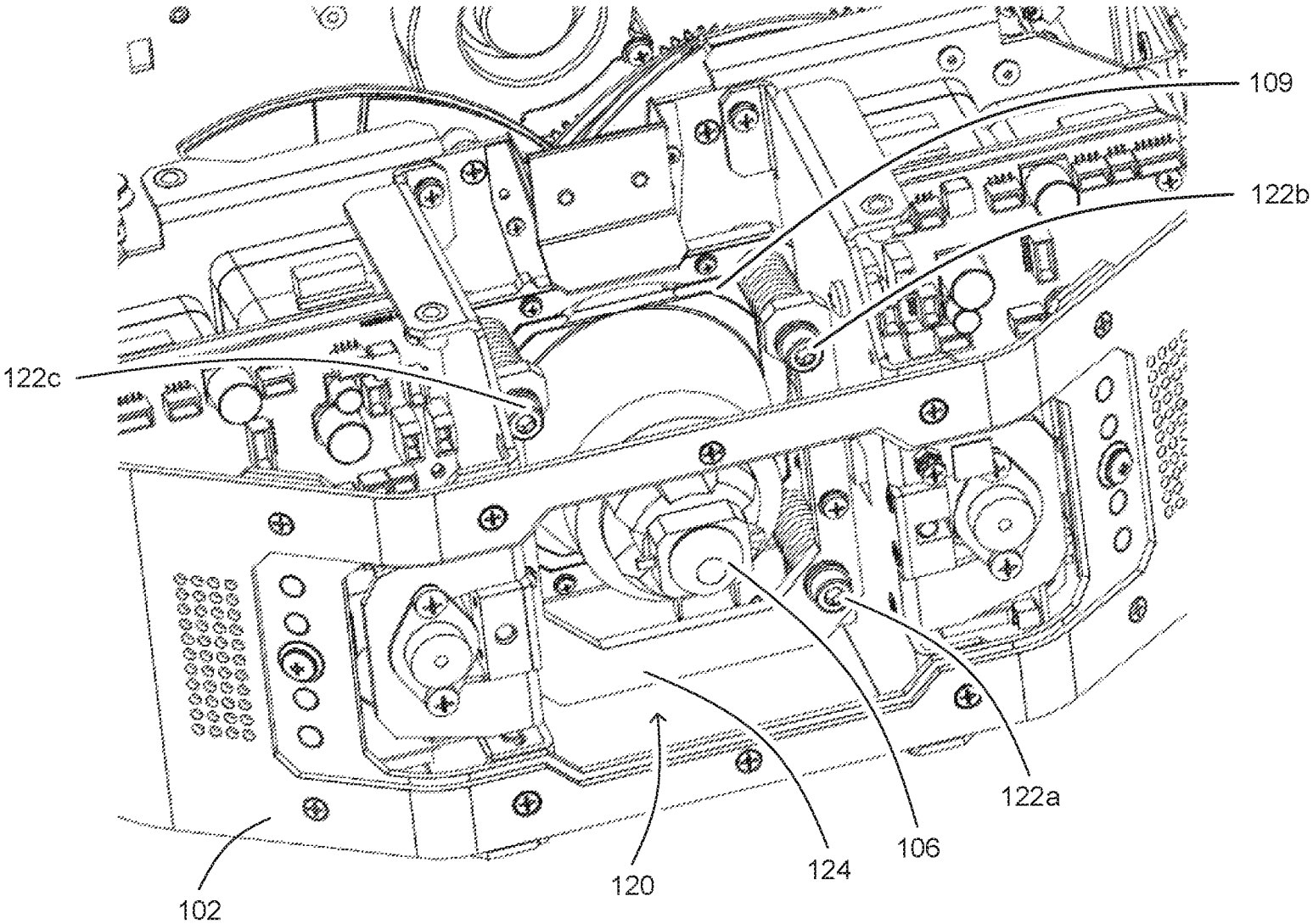
FIG. 8 shows a cutaway drawing of the lamp head of FIG. 2.

FIG. 8 shows a cutaway drawing of the lamp head 102. As described with reference to FIGS. 4-6, the lamp mounting mechanism 130 remains mounted in the lamp head 102 during the removal of a lamp 106 and the installation of a new lamp 106. In FIG. 8, the lamp 106 is firmly installed in the lamp mounting mechanism 130.

The lamp mounting mechanism 130 is mounted in the lamp head 102 by a lamp adjustment mechanism 120 comprising a lamp adjustment plate 124 and adjustment screws 122*a*, 122*b*, and 122*c*. The adjustment screws 122*a-c* pass through respective clearance holes in the lamp adjustment plate 124 and are threaded into threaded holes in three corresponding corners of the lamp mounting plate 109. Coaxial springs around each of the adjustment screws 122*a-c* hold the screws' heads against the lamp adjustment plate 124.

The center 117 of the lamp mounting plate 109 of the lamp mounting mechanism 130 is aligned with an optical axis of the lamp head 102. By operating the adjustment screws 122*a* and 122*b*, the optical axis of the lamp 106 may be tilted up and down (in the orientation shown in FIG. 8). By operating the adjustment screws 122*b* and 122*c*, the optical axis of the lamp 106 may be tilted left and right. By operating all of the adjustment screws 122*a-c* in the same direction, the lamp 106 is moved along the optical axis of the lamp head 102 to position the arc of the lamp 106 in a desired position relative a focal point of an optical system of the lamp head 102.

While the disclosure has been described with respect to a limited number of embodiments, those skilled in the art, having benefit of this disclosure, will appreciate that other embodiments may be devised which do not depart from the scope of the disclosure herein. While the disclosure has been described in detail, it should be understood that various changes, substitutions and alterations can be made hereto without departing from the spirit and scope of the disclosure.

What is claimed is:

1. A lamp mounting mechanism for use in an automated luminaire, the lamp mounting mechanism comprising:

a lamp mounting plate comprising:

a feature configured to engage a plurality of flanges of a lamp removably mounted in the lamp mounting mechanism and to align an optical axis of the lamp with a center of the lamp mounting plate; and a plurality of threaded holes;

a lamp retainer coupled to the lamp mounting plate, the lamp retainer comprising;

a plurality of retaining clips, the number of retaining clips equaling the number of flanges of the lamp;

the retaining clips being configured to apply forces to corresponding ones of the plurality of flanges of the lamp to maintain the lamp in a fixed position relative to the lamp mounting plate when the flanges of the lamp are positioned between the retaining clips and the feature of the lamp mounting plate, the retaining clips being further configured to allow a user of the lamp mounting mechanism to rotate the lamp within the feature of the lamp mounting plate to position the flanges of the lamp in openings between the retaining clips, and the openings between the retaining clips being configured to allow the user to remove the lamp from the feature of the lamp mounting plate; and a lamp adjustment plate fixedly coupled to the automated luminaire, the lamp adjustment plate comprising a plurality of adjustment screws, each adjustment screw engaging a corresponding threaded hole of the lamp mounting plate, wherein rotation of any one of the adjustment screws causes the lamp mounting plate to tilt relative to the lamp adjustment plate.

2. The lamp mounting mechanism of claim 1, wherein the feature of the lamp mounting plate comprises an inset ring and the retaining clips extend over the inset ring and are configured to hold a front face of the lamp against a face of the inset ring.

3. The lamp mounting mechanism of claim 2, wherein the flanges of the lamp are protrusions that are coplanar with the front face of the lamp and the retaining clips and the inset ring are configured to receive the protrusions between the retaining clips and the face of the inset ring.

4. The lamp mounting mechanism of claim 2, wherein the inset ring forms a shoulder and the shoulder has a dimension configured to fit the flanges of the lamp and to prevent radial movement of the lamp away from alignment with the center of the lamp mounting mechanism.

5. The lamp mounting mechanism of claim 1, wherein the retaining clips are features of the lamp retainer.

6. The lamp mounting mechanism of claim 5, wherein the retaining clips comprise spring steel.

7. The lamp mounting mechanism of claim 1, wherein the lamp mounting plate comprises a plurality of threaded holes configured to receive adjustment screws to mount the lamp mounting mechanism in an automated luminaire.

8. The lamp mounting mechanism of claim 1, wherein the retaining clips are separate elements attached to the lamp mounting plate.

9. An automated luminaire, comprising a lamp head, the lamp head comprising:

a lamp access panel, removably mounted to the lamp head and configured to form a portion of a housing of the lamp head when mounted to the lamp head; and a lamp mounting mechanism coupled to the lamp head and configured to be accessed by a user when the lamp access panel is removed, the lamp mounting mechanism comprising:

a lamp mounting plate comprising:

a feature configured to engage a plurality of flanges of a lamp removably mounted in the lamp mounting mechanism and to align an optical axis of the lamp with a center of the lamp mounting plate; and a plurality of threaded holes;

a lamp retainer coupled to the lamp mounting plate, the lamp retainer comprising;

a plurality of retaining clips, the number of retaining clips equaling the number of flanges of the lamp;

the retaining clips being configured to apply forces to corresponding ones of the plurality of flanges of the lamp to maintain the lamp in a fixed position relative to the lamp mounting plate when the flanges of the lamp are positioned between the retaining clips and the feature of the lamp mounting plate, the retaining clips being further configured to allow the user to rotate the lamp within the feature of the lamp mounting plate to position the flanges of the lamp in openings between the retaining clips, and the openings between the retaining clips being configured to allow the user to remove the lamp from the feature of the lamp mounting plate; and a lamp adjustment mechanism comprising a lamp adjustment plate fixedly coupled to the lamp head, the lamp adjustment plate comprising a plurality of adjustment screws, each adjustment screw engaging a corresponding threaded hole of the lamp mounting plate, wherein rotation of any one of the adjustment screws causes the lamp mounting plate to tilt relative to the lamp adjustment plate.

10. The automated luminaire of claim 9, wherein the adjustment screws are configured to be accessed by a user when the lamp access panel is removed.

11. The automated luminaire of claim 9, wherein a first and second adjustment screws of the plurality of adjustment screws are configured to tilt the lamp mounting plate in a first direction relative to the lamp head.

12. The automated luminaire of claim 11, wherein the second and a third adjustment screws of the plurality of adjustment screws are configured to tilt the lamp mounting plate in a second direction relative to the lamp head, the second direction being orthogonal to the first direction.

13. The automated luminaire of claim 9, wherein the lamp adjustment mechanism further comprises a plurality of springs, each spring positioned coaxially around a corresponding one of the plurality of adjustment screws and configured to hold a screw head of the corresponding adjustment screw against the lamp adjustment plate.

14. The automated luminaire of claim 9, wherein the feature of the lamp mounting plate comprises an inset ring and the retaining clips extend over the inset ring and are configured to hold a front face of the lamp against the inset ring.

15. The automated luminaire of claim 14, wherein the flanges of the lamp are protrusions that are coplanar with the front face of the lamp and the retaining clips and the inset ring are configured to receive the protrusions between the retaining clips and a face of the inset ring.

16. The automated luminaire of claim 14, wherein the inset ring forms a shoulder and the shoulder has a dimension configured to fit the flanges of the lamp and to prevent radial movement of the lamp away from alignment with the center of the lamp mounting mechanism.

17. The automated luminaire of claim 9, wherein the retaining clips are features of the lamp retainer.

18. The automated luminaire of claim 17, wherein the retaining clips comprise spring steel.

19. The automated luminaire of claim 9, wherein the retaining clips are separate elements attached to the lamp mounting plate.

* * * * *